US010240894B1

(12) United States Patent
Shows

(10) Patent No.: US 10,240,894 B1
(45) **Date of Patent: *Mar. 26, 2019**

(54) FIREARM COVER ATTACHABLE TO A HOLSTER

(71) Applicant: Luke N Shows, Cantonment, FL (US)

(72) Inventor: Luke N Shows, Cantonment, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/899,139

(22) Filed: Feb. 19, 2018

(51) Int. Cl.
*F41A 35/02* (2006.01)
*F41C 33/04* (2006.01)
*F41C 33/02* (2006.01)

(52) U.S. Cl.
CPC ..... *F41C 33/0218* (2013.01); *F41C 33/041* (2013.01); *F41C 33/048* (2013.01)

(58) Field of Classification Search
CPC ..... A45F 2200/0591; A45C 13/002; F41C 33/0218; F41C 35/02; F41C 33/04; F41A 35/02
USPC ..... 224/587
See application file for complete search history.

(56) References Cited

U.S. PATENT DOCUMENTS 4,901,852 A * 2/1990 King ..... B65D 65/02 206/320
RE37,155 E * 5/2001 Andersen ..... A45C 11/08 224/194
6,305,538 B1 * 10/2001 Jackson ..... A45C 11/24 206/316.1
7,059,503 B2 * 6/2006 Andersen ..... A45F 3/14 224/578
8,132,669 B1 * 3/2012 Stubel ..... A45C 11/08 206/316.3
9,933,234 B1 * 4/2018 Shows ..... F41A 35/02
2005/0110976 A1 * 5/2005 LaBelle ..... G01C 3/08 356/5.01
2007/0175787 A1 * 8/2007 Lown ..... A45F 3/16 206/427
2010/0236954 A1 * 9/2010 Brown ..... A45C 11/00 206/315.9
2014/0158733 A1 * 6/2014 McDonnell ..... B60R 7/14 224/587
2015/0351571 A1 * 12/2015 Johnson ..... A45F 5/00 224/250

* cited by examiner

*Primary Examiner* — Adam J Waggenspack
(74) *Attorney, Agent, or Firm* — Peter Loffler

(57) ABSTRACT

A cover for use with a firearm holster uses a main panel with an upper pocket that has a first opening and a lower pocket that has a second opening facing toward the first opening. Optional side pockets are located on either side of the main panel, the side pockets having openings that face each other. The cover is made from an appropriate elasticized material or materials. The cover is positioned so that the upper pocket is positioned over the exposed handle end of a firearm and an upper portion of the holster with the main panel acting as a cushion between the firearm holding holster and a user. The lower pocket and the side pockets each receive a portion of the holster for added stability of the installed cover and to cinch the device about the firearm and holster.

9 Claims, 6 Drawing Sheets

FIREARM COVER ATTACHABLE TO A HOLSTER

BACKGROUND OF THE INVENTION

1. Field of the Invention

The present invention relates to a removable cover that is positioned over the exposed end of a holstered handgun in order to provide a barrier between the exposed portion of the handgun and a person carrying the handgun in either an inside the waistband or outside the waistband position.

2. Background of the Prior Art

As the world becomes more complex, and is perceived to be more dangerous, more and more people are learning to use firearms, especially handguns, for self-defense. Coupled with such firearm proficiency, people, both men and women, in record numbers are applying for, and receiving concealed carry permits that allow the holders of such permits to carry firearms and other weapons on their person in a concealed manner. One of the concealed carry methods preferred by many, especially by men but also by many women, is to position the firearm about the waistband of a person's pants. The firearm, which is typically holstered in appropriate fashion, is positioned either inside the waistband of the person's pants or outside the waistband of the person's pants, clipped via the holster to either the waistband proper of the pants or to a belt being worn in conjunction with the pants. A shirt or other type of torso cover overlays the firearm so positioned in order to conceal the firearm from view of others. Most often, the holstered firearm is positioned proximate the person's hip, but is occasionally located proximate the small of the person's back or up front just below the person's bellybutton. This method of concealed carry is relatively conformable and provides fast and easy access to the firearm in case of emergency.

While an effective concealed carry position, waistband placement of the firearm has a major drawback in that in order to conceal the firearm, the person's shirt or other type of torso cover is, by necessity, placed in covering relationship with the firearm so that the exposed portion of the firearm, the portion not within the holster, presses up against the person's skin. Over time, as the person goes about his or her business, the firearm and its holster rub against the skin, sometimes leading to chaffing of the skin, all of which is quite uncomfortable. For some, depending on placement of the holstered firearm and the firearm's cant, the firearm may also dig into the person's pelvis, exacerbating the discomfort. If the person sweats while carrying the firearm, the sweat transfers to the firearm requiring frequent cleaning of the firearm in order to prevent damage thereto. Additionally, such sweat creates the need to replace the ammunition within the firearm for fear of the sweat and the oils carried thereby, leaching into the ammunition which can result in disabling of the ammunition.

To combat this problem, some waistband position concealed carriers put on a base garment, such as an undershirt, that is positioned between the person's skin and the firearm. This base garment helps prevent chafing of the person's skin that would otherwise be caused by the exposed handle end of the firearm and the back of the holster. While reasonably effective, this solution is not without its drawbacks. If the temperature is warm, such as during summer months or in southern climates, a base garment, even a relatively thin garment, is uncomfortable to the wearer and creates additional sweat. As such, the concealed carrier is exchanging one form of discomfort for another. Additionally, if the person wearing the base garment is relatively active, the base garment can ride up the person's torso, often settling back so as to be positioned over the firearm, that is between the firearm and the outer garment, instead of between the firearm and the person's skin, resulting in the need for awkward repositioning of the base garment.

What is needed is a device that increases the overall comfort to a person carrying a concealed firearm in an inside the waistband or outside the waistband manner, which device addresses the above stated shortcomings found in the art. Such a device must act as a barrier between the exposed portion of the firearm and the back of the holster and the person's skin without the need for the person to wear additional clothing with the attendant problem of being uncomfortably warm. Such a device must stay properly positioned even if the user is physically active during device usage. Such a device should be of relatively simply design and be easy to use without unnecessarily inhibiting access to the firearm.

SUMMARY OF THE INVENTION

The firearm cover attachable to a holster of the present invention addresses the aforementioned needs in the art by providing a device that acts as a barrier between the exposed portion of a firearm—that portion of the firearm not within or backed by a holster—as well as the holster itself, and a person's skin whenever the person is carrying the firearm in an inside the waistband or outside the waistband manner. The firearm cover attachable to a holster eliminates the need for the person to don a base garment to provide such a barrier yet helps prevent the transfer of sweat and oils from the user's skin to the firearm. The firearm cover attachable to a holster is of relatively simple design and construction, being produced using standard manufacturing techniques, so as to make the device relatively inexpensive to produce so as to make the device economically attractive for potential consumers of this type of device. The firearm cover attachable to a holster is easy to use and tends not to require readjustment if the user is physically active while deploying the device. The firearm cover attachable to a holster is easy to install and does not unnecessarily inhibit access to the firearm if needed, yet provides secondary concealment of the firearm if the user's outer garment inadvertently rides up over the firearm.

The firearm cover attachable to a holster of the present invention is comprised of a main panel that has a top edge and an opposing bottom edge joined by a first side edge and a second side edge. An upper panel is attached to the top edge of main panel and to a first upper portion of the first side edge and to a second upper portion of the second side edge in order to form an upper pocket. The upper pocket has a first opening that faces toward the bottom edge of the main panel. The main panel is formed from a first elasticized material and the upper panel is formed from a second elasticized material so that when a firearm is disposed within the firearm receiver of the holster, the upper pocket receives an exposed handle end of the firearm and an upper portion of the holster and cinches the main pocket about the exposed handle end of the firearm and the upper portion of the holster. A lower panel is attached to the bottom edge of main panel and to a first lower portion of the first side edge and to a second lower portion of the second side edge in order to form a lower pocket. The lower pocket has a second opening that faces toward the first opening of the upper pocket. The lower panel is formed from a third elasticized material. The first elasticized material, the second elasticized material, and the third elasticized material may all be the same material, although need not necessarily be. While all components may be made from a single layer of material, at least the main panel may be made from a first layer of material and a second layer of material wherein the first layer of material is distinct from the second layer of material. Some of the layers of material of the main panel (and the upper panel and lower panel if so configured) is a moisture absorbent material and/or may be a moisture impervious material and/or may be a resilient cushioning material. An optional first side panel is attached to the first side edge of main panel and to the upper panel and to the lower panel in order to form a first side pocket. The first side pocket has a third opening that faces toward the second side edge. The first side panel is formed from a fourth elasticized material. An optional second side panel is attached to the second side edge of main panel and to the upper panel and to the lower panel in order to form a second side pocket. The second side pocket has a fourth opening that faces toward the third opening. The second side panel is formed from a fifth elasticized material. The material used to make the main panel, the upper panel, the lower panel, and the two side panels may all be homogenous or at least some of the panels can be formed of material that is different (partially or fully) relative to the other panels.

BRIEF DESCRIPTION OF THE DRAWINGS

Similar reference numerals refer to similar parts throughout the several views of the drawings.

DESCRIPTION OF THE PREFERRED EMBODIMENT

Figure 1:
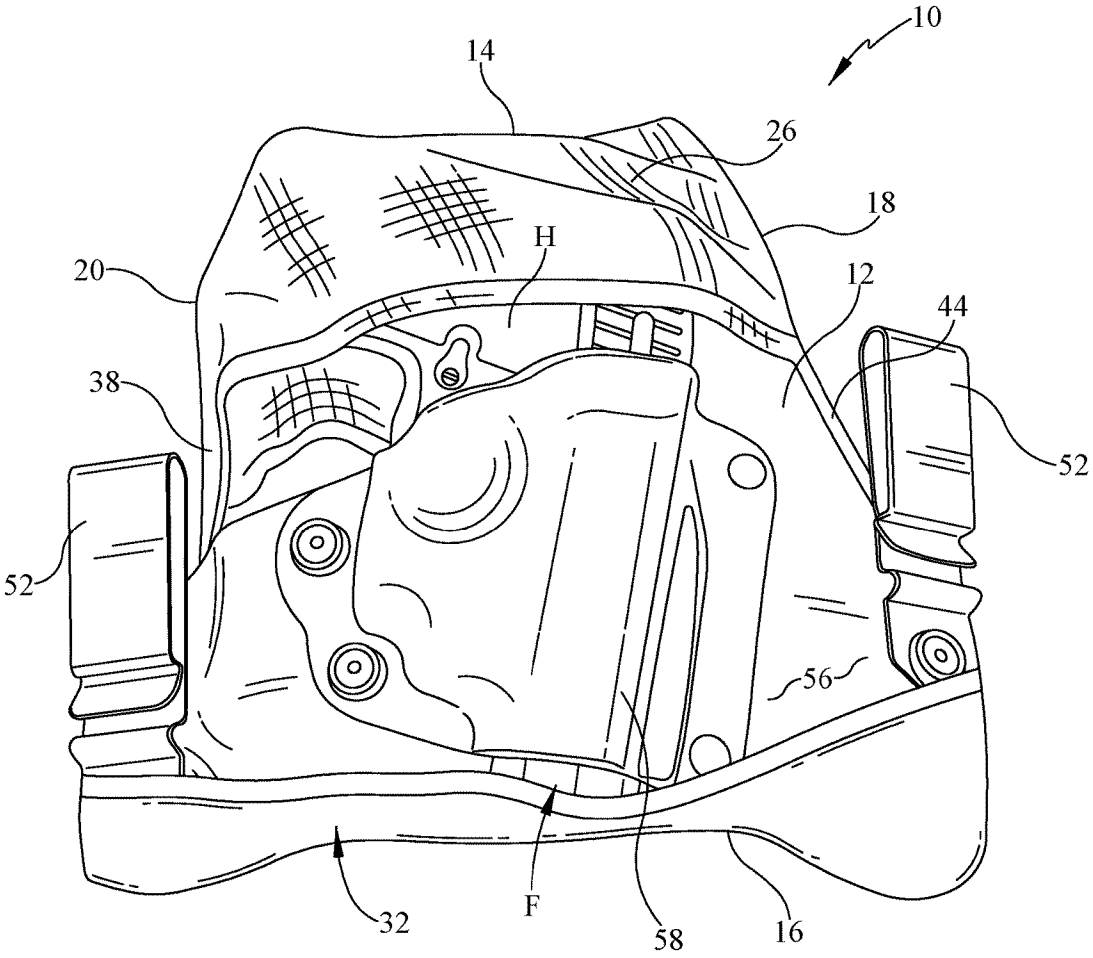
FIG. 1 is front environmental view of the firearm cover attachable to a holster of the present invention.
Figure 2:
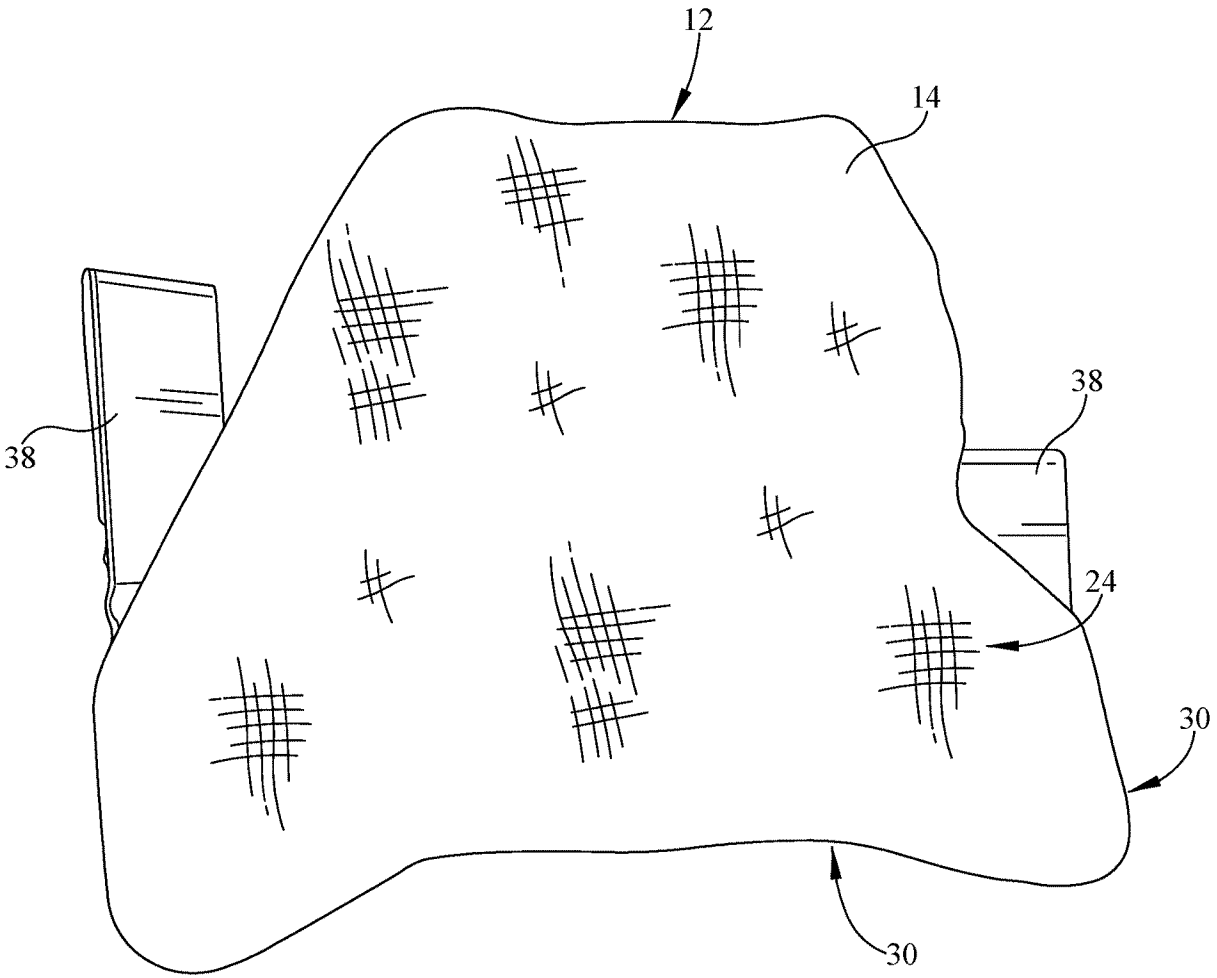
FIG. 2 is a rear environmental view of the firearm cover attachable to a holster.
Figure 3:
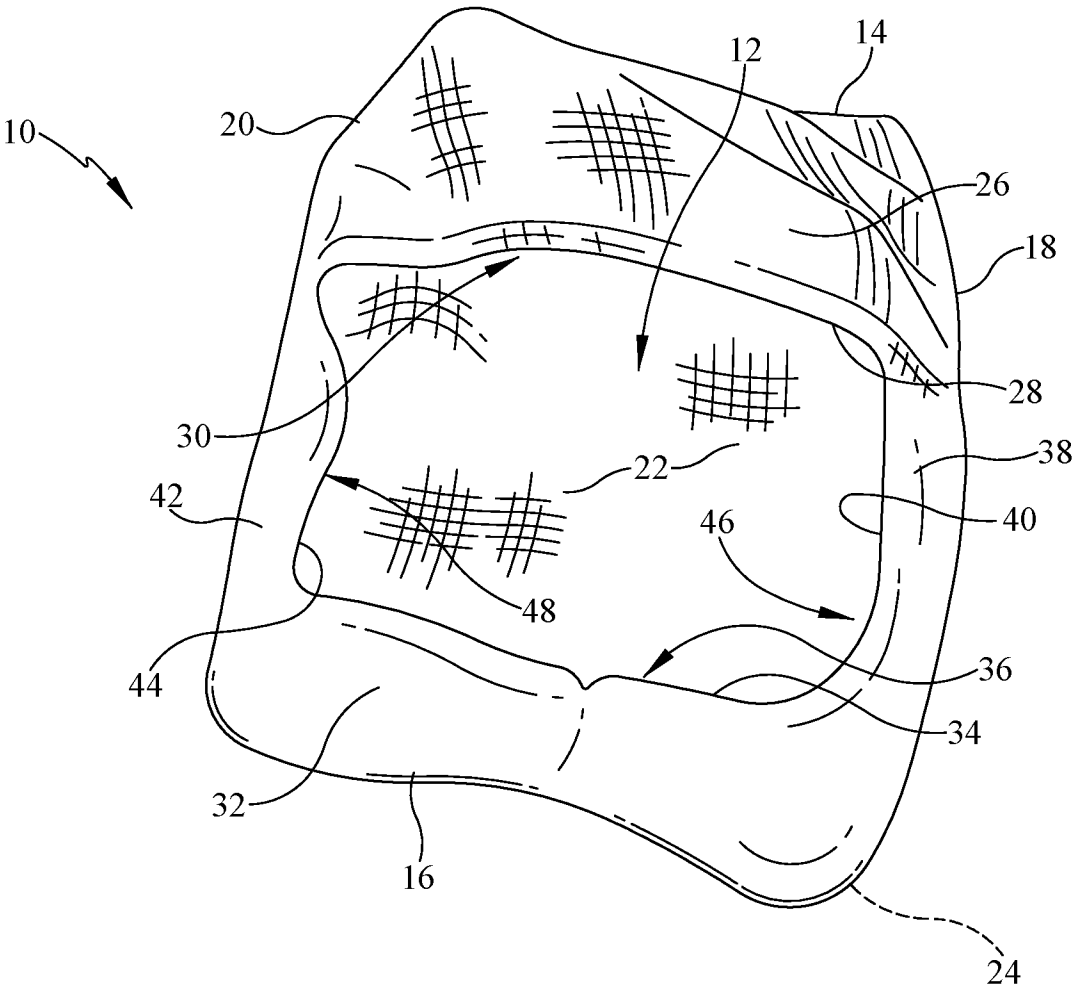
FIG. 3 is a perspective view of the firearm cover attachable to a holster.

Referring now to the drawings, it is seen that the firearm cover attachable to a holster of the present invention, generally denoted by reference numeral 10, is comprised of a main panel 12 that has a top edge 14, an opposing bottom edge 16, a first side edge 18 and an opposing second side edge 20, as well as an upper surface 22 and a lower surface 24. The main panel 12 may, but need not necessarily be generally rectangular in shape. An upper panel 26 extends from the top edge 14 of the main panel 12 toward the bottom edge 16 of the main panel 12 and extends between the first side edge 18 and the second side edge 20 forming an upper pocket. The upper panel 26 has a first outer edge 28. The opening 30 to the upper pocket faces toward the bottom edge 16 of the main panel 12. A lower panel 32 extends from the bottom edge 16 of the main panel 12 toward the top edge 14 of the main panel 12 and extends between the first side edge 18 and the second side edge 20 forming a lower pocket. The lower panel 32 has a second outer edge 34. The opening 36 to the lower pocket faces toward the top edge 14 of the main panel 12. The depth of the upper panel 26 is somewhat greater than the depth of the lower panel 32, the depth being defined as the distance between the outer edge of the pocket and its respective edge of the main panel 12. The upper panel 26 and the lower panel 32 can each be standalone, or as seen, a first side panel 38 extends from the first side edge 18 and connects to the upper panel 26 and to the lower panel 32 forming a first side pocket, the first side panel having a third outer edge 40 while a second side panel 42 extends from the second side edge 20 and connects to the upper panel 26 and to the lower panel 32 forming a second side pocket and has a fourth outer edge 44. The opening 46 to the first side pocket faces the second side pocket while the opening 48 to the second side pocket faces the first side pocket and both the first side pocket and the second side pocket merge into both the upper pocket and the lower pocket on the side pockets' respective sides of the main panel 12. In this configuration, the first outer edge 28, the second outer edge 34, the third outer edge 40 and the fourth outer edge 44, form a continuous outer edge.

The first outer edge 28 and the second outer edge 34, and if the two side panels 38 and 44 are used, the third outer edge 40 and the fourth outer edge 44 are each appropriately finished such as via a hem or selvaging, or piping (not illustrated), etc., or some combination thereof The main panel 12, the upper panel 26 and the lower panel 32, as well as the first side panel 38 and the second side panel 44, if used, can be made from any appropriate material such as cotton, cotton blend, terrycloth, polyester, silk, bamboo, etc., and each is elasticized, as is the piping, if used The main panel 12, the upper panel 26 and the lower panel 32, as well as the first side panel 38 and the second side panel 44, if used, may each be formed as a single layer of the just mentioned material or may have one or more additional layers (none illustrated) for added functionality. For example, the inner surfaces of the main panel 12 and the upper panel 26 and the lower panel 32, and possibly the first side panel 38 and the second side panel 44, if used, may each be lined with an appropriate grip material, such as a gooey material, which can include rubber, neoprene, etc. Additionally, the inner surfaces of the main panel 12, the upper panel 26 and the lower panel 32, as well as the first side panel 38 and the second side panel 44, if used, may have either a moisture absorption layer or a moisture impervious layer, or both thereon. Further, the inner surface of at least the main panel 12 may have a soft resilient layer, such as foam (this layer may act as a moisture absorption layer). The main panel 12, the upper panel 26 and the lower panel 32, as well as the first side panel 38 and the second side panel 44, if used, may be a single layer of material or may each be two or more layers thick of a combination of materials. The main panel 12 may be configured different relative to the upper panel 26 and the lower panel 32, as well as the first side panel 38 and the second side panel 44, if used (different material and/or different layering—for example, the main panel 12 may be multilayered while the upper panel 26 and the lower panel 32 as well as the first side panel 38 and second side panel 44, if provided, may be single layered), or the main panel 12, the upper panel 26 and the lower panel 32, as well as the first side panel 38 and the second side panel 44, if used, may all be homogenous in material.

The firearm cover attachable to a holster 10 may be formed of discreet panels, so that the upper panel 26 and the lower panel 32 are each separate panels that are stitched or otherwise appropriately attached to the main panel 12, or the main panel 12, the upper panel 26, and the lower panel 32 may be made from a single piece of material, folded and stitched or otherwise attached appropriately to form the two pockets 26 and 32. The side panels 38 and 44 may be similarly configured.

Figure 6:
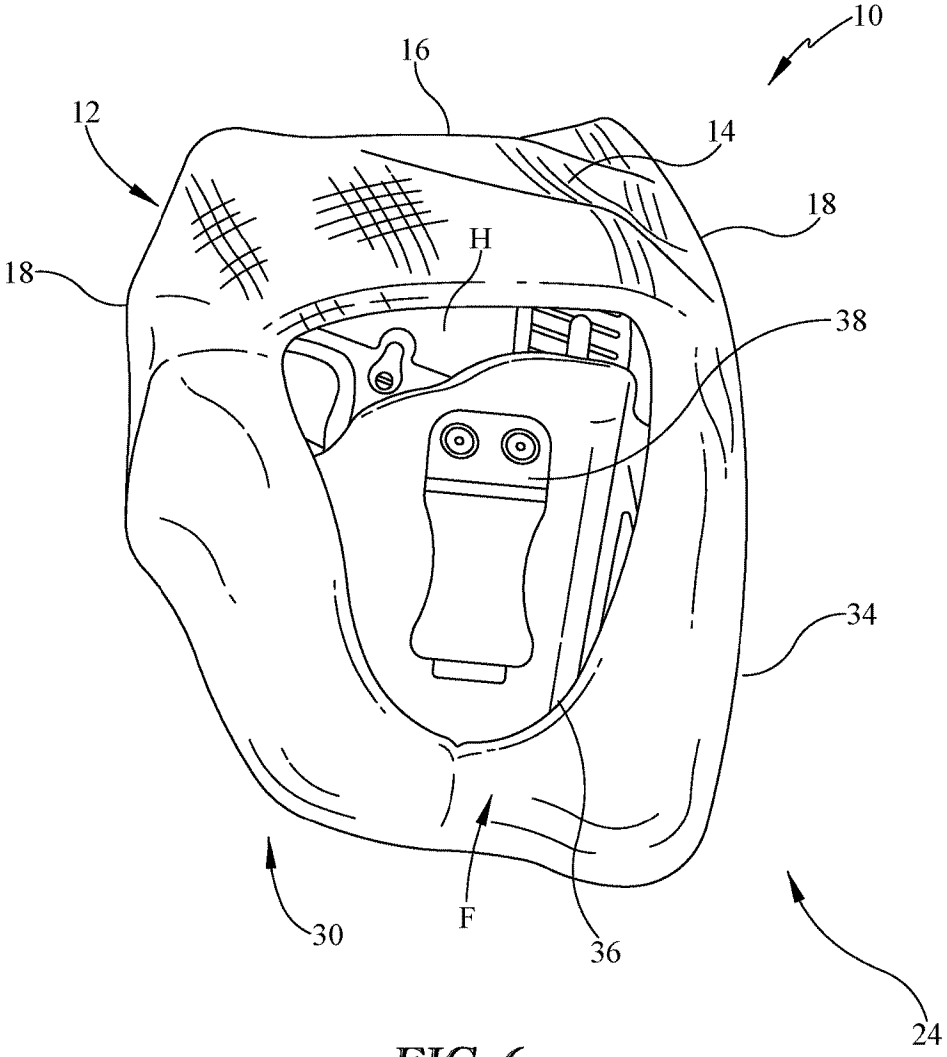
FIG. 6 is an environmental view of the firearm cover attachable to a holster used on a different type of holster system.

In order to use the firearm cover attachable to a holster 10 of the present invention, a firearm holster 50 of appropriate design is provided. The holster 50 may be an inside the waistband type of holster as illustrated or an outside the waistband holster, a single clip holster, as seen in FIG. 6, or a double clip holster as seen in FIGS. 1, 2, 4 and 5, the clips 52 used to attach the holster 50 to the waistband or belt being worn by a user. As seen, the holster 50 has a first surface 54 and an opposing second surface 56 which has a firearm receiver 58 thereon to removably receive a firearm F therein. With the firearm F holstered within the firearm receiver 58, and the holster 50 clipped to a user's item of clothing in appropriate fashion, the main panel 12 is positioned overtop the exposed handle end H of the firearm F and the upper portion of the holster 50 such that the main panel 12 is positioned between the holster 50 and firearm F and the user's exposed skin proximate the site of the holster 50 so that in the inside the waistband configured holster as seen, the upper panel 26 is positioned overtop the firearm F and a portion of the upper section of the holster 50, thereby covering the handle H of the firearm F and the lower panel 32 receives a portion of the lower section of the holster 50. If the first side panel 38 and the second side panel 44 are used, they each receive a portion of a respective one of the sides of the holster 50, thereby cocooning the holster 50 and its firearm F within the firearm cover attachable to a holster 10. The main panel 12 acts as a buffer and a cushion between the handle end H of the firearm F as well as the holster 50 and the person's exposed skin and helps prevent chafing or other discomforts caused by the handle H of firearm F and holster 50 to skin contact. If the main panel 12 that is pressing against the user's skin has additional layers, these additional layers increase the usefulness of the device. For example, if the main panel 12 has a resilient layer and a moisture impervious layer, then the two layers help cushion the handle H and the holster 50 contact against the skin and absorb excess sweat that may form thereat, as well as prevent the sweat from passing through to the firearm F. The upper panel 26 covers the firearm F while the lower panel 32 and the first side panel 38 and the second side panel 44, if used, help hold the firearm cover attachable to a holster 10 in place about the holster 50 and its firearm. The elastic nature of the components of the firearm cover attachable to a holster 10 help cinch the firearm cover attachable to a holster 10 about the holster 50 and firearm F, specifically the upper pocket and the lower pocket together bias the firearm cover attachable to a holster 10 about the firearm F and help resist the upper pocket from coming off of the upper portion of the firearm F without the user pulling on the upper pocket with the side pockets, if used, providing additional bias.

If access to the firearm F is needed, the upper panel 26 is removed from the handle end H of the firearm F by simply pulling it off overcoming the moderate bias of the elasticization of the firearm cover attachable to a holster 10 and the firearm F is unholstered in standard fashion. Once the firearm F is reholstered, the upper pocket is once again placed onto the handle end H of the firearm F and the upper section of the holster 50 and if not so positioned, the lower pocket receives the lower portion of the holster, the two pockets again helping bias the device about the holster 50 and firearm F. The firearm cover attachable to a holster 10 also helps cover the firearm F in the event that the covering torso top of the user inadvertently lifts up to expose the holster 50 and firearm F in order to maintain the firearm F in a concealed manner so as to avoid potential problems with the law in a particular jurisdiction that may criminalize even inadvertent firearm exposure.

The cover for a firearm holster 10 is appropriately sized for the size of the holster 50 and the firearm F which the holster 50 carries.

Figure 4:
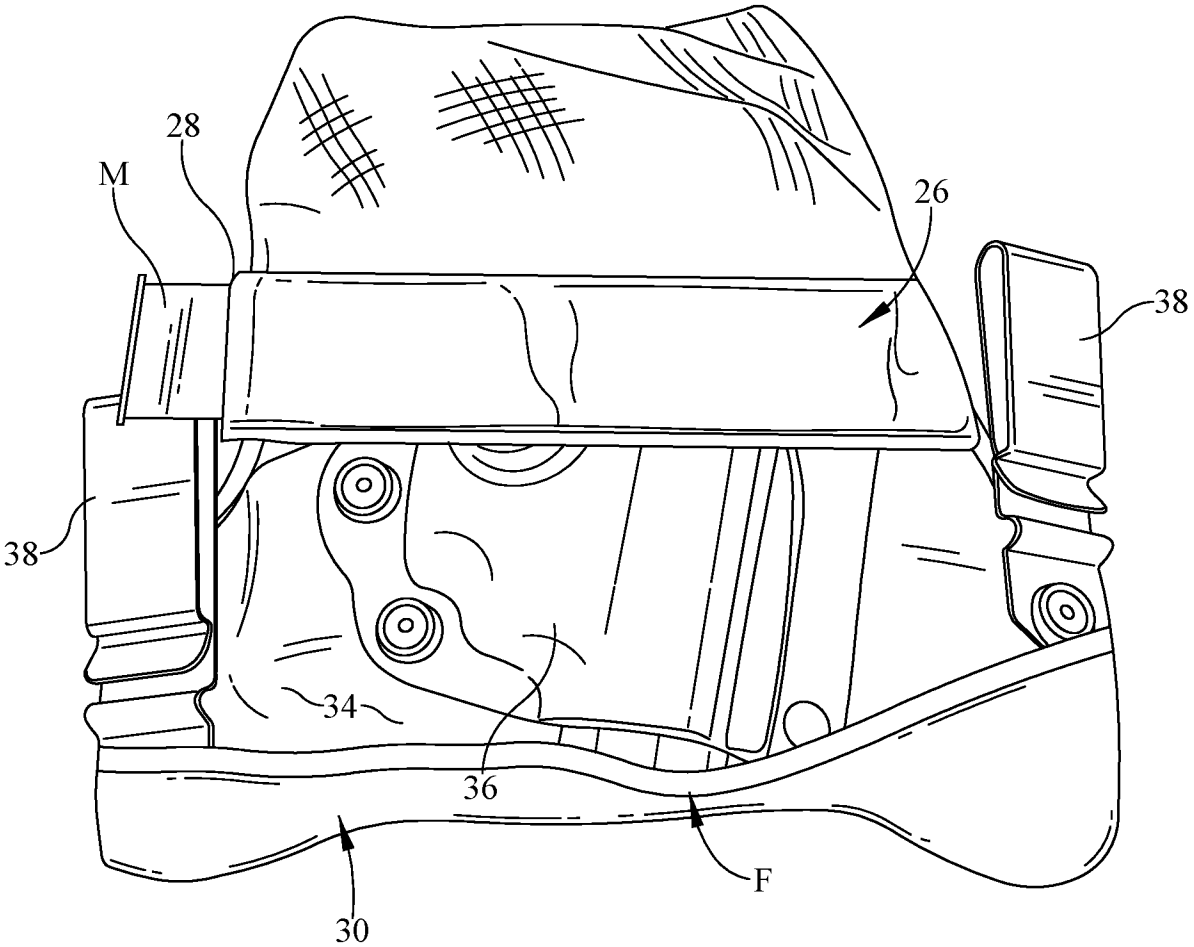
FIG. 4 is a front environmental view of the firearm cover attachable to a holster with an optional magazine pocket.
Figure 5:
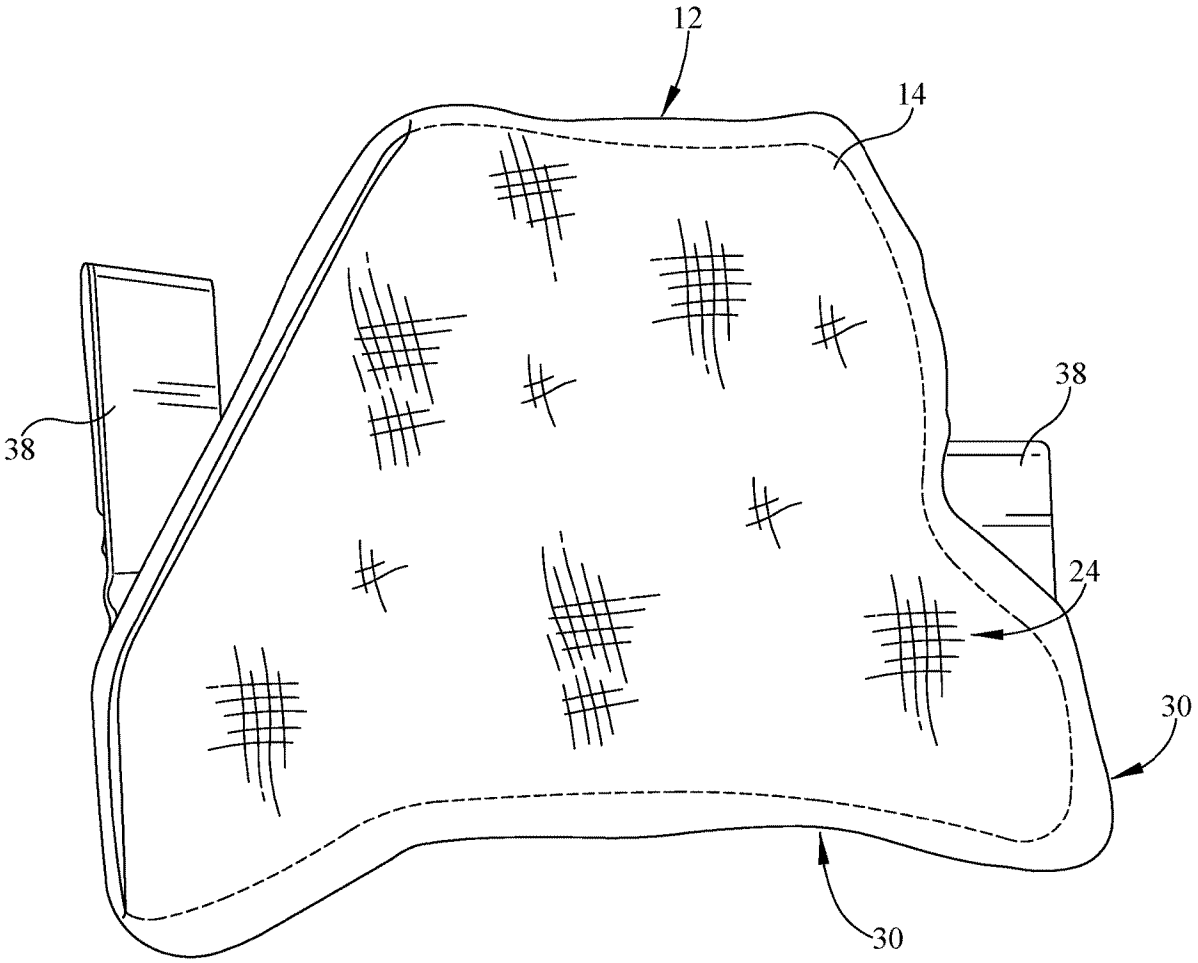
FIG. 5 is a rear environmental view of the firearm cover attachable to a holster.

As seen in FIG. 4, an additional pocket 60 with a transverse opening, may be located on an outer surface of the upper panel 26 in order to hold an additional firearm magazine M therein While the invention has been particularly shown and described with reference to an embodiment thereof, it will be appreciated by those skilled in the art that various changes in form and detail may be made without departing from the spirit and scope of the invention.

I claim:

1. A cover in combination with a firearm holster, the firearm holster having a body member that has a firearm receiver that removably receives a firearm therein, the cover comprising:

a main panel having a top edge and an opposing bottom edge joined by a first side edge and a second side edge;

an upper panel attached to the top edge of main panel and to a first upper portion of the first side edge and to a second upper portion of the second side edge in order to form an upper pocket, the upper pocket having a first opening that faces toward the bottom edge of the main panel; and wherein the main panel is formed from a first elasticized material and the upper panel is formed from a second elasticized material and such that when a firearm is disposed within the firearm receiver of the holster, the upper pocket receives an exposed handle end of the firearm and an upper portion of the holster and cinches the main pocket about the exposed handle end of the firearm and the upper portion of the holster.

2. The cover for a firearm holster as in claim 1 wherein the first elasticized material and the second elasticized material are the same.

3. The cover for a firearm holster as in claim 1 further comprising a lower panel attached to the bottom edge of main panel and to a first lower portion of the first side edge and to a second lower portion of the second side edge in order to form a lower pocket, the lower pocket having a second opening that faces toward the first opening of the upper pocket, the lower panel formed from a third elasticized material.

4. The cover for a firearm holster as in claim 3 wherein the first elasticized material, the second elasticized material, and the third elasticized material are all the same.

5. The cover for a firearm holster as in claim 3 further comprising:

a first side panel attached to the first side edge of main panel and to the upper panel and to the lower panel in order to form a first side pocket, the first side pocket having a third opening that faces toward the second side edge, the first side panel formed from a fourth elasticized material; and a second side panel attached to the second side edge of main panel and to the upper panel and to the lower panel in order to form a second side pocket, the second side pocket having a fourth opening that faces toward the third opening, the second side panel formed from a fifth elasticized material.

6. The cover as in claim 1 wherein the main panel is made from a first layer of material and a second layer of material wherein the first layer of material is distinct from the second layer of material.

7. The cover for a firearm holster as in claim 6 wherein the first layer of material is a moisture absorbent material.

8. The cover for a firearm holster as in claim 6 wherein the first layer of material is a moisture impervious material.

9. The cover for a firearm holster as in claim 6 wherein the first layer of material is a resilient cushioning material.

* * * * *